US007431679B1

(12) United States Patent
Tageant

(10) Patent No.: US 7,431,679 B1
(45) Date of Patent: Oct. 7, 2008

(54) DUAL PURPOSE HOME APPARATUS

(76) Inventor: Rose M Tageant, P.O. Box 55, Neah Bay, WA (US) 98357

( * ) Notice: Subject to any disclaimer, the term of this patent is extended or adjusted under 35 U.S.C. 154(b) by 0 days.

(21) Appl. No.: 11/681,332

(22) Filed: Mar. 2, 2007

(51) Int. Cl.
*A63B 5/11* (2006.01)
*A47C 19/00* (2006.01)

(52) U.S. Cl. ..... 482/27; 482/29; 5/110

(58) Field of Classification Search ..... 482/26–32; 5/110–112, 187; 248/611, 618, 603; 211/28; 297/208
See application file for complete search history.

(56) References Cited

U.S. PATENT DOCUMENTS

| | | | | | |
|---|---|---|---|---|---|
| 952,871 | A * | 3/1910 | Browder | 182/139 |
| 1,311,579 | A * | 7/1919 | Takeuchi | 5/112 |
| 1,927,109 | A * | 9/1933 | Abrams | 5/722 |
| 2,646,577 | A * | 7/1953 | Thayer | 5/114 |
| 2,809,383 | A * | 10/1957 | Fenner et al. | 482/28 |
| 3,635,471 | A * | 1/1972 | Caron | 482/4 |
| 3,831,936 | A * | 8/1974 | Watson et al. | 482/27 |
| 3,891,208 | A * | 6/1975 | Sidlinger | 482/27 |
| 3,892,403 | A | 7/1975 | Green | |
| 4,037,834 | A * | 7/1977 | Oaks | 482/27 |
| 4,119,311 | A * | 10/1978 | Jenkins et al. | 482/27 |
| 4,663,787 | A * | 5/1987 | Kolsch | 5/110 |
| 4,752,976 | A * | 6/1988 | Fanning | 5/13 |
| 5,241,717 | A * | 9/1993 | Ward et al. | 5/201 |
| 5,729,852 | A | 3/1998 | Rabideau et al. | |
| 6,001,045 | A * | 12/1999 | Gift et al. | 482/27 |
| 6,129,649 | A | 10/2000 | Yang | |
| 6,253,396 | B1 * | 7/2001 | Weston | 5/110 |
| 6,286,456 | B1 | 9/2001 | Michaelis | |
| 6,560,795 | B2 * | 5/2003 | Hsia | 5/186.1 |
| 6,733,420 | B1 | 5/2004 | Schroeder | |
| 2006/0116243 | A1 * | 6/2006 | Wyman | 482/27 |

* cited by examiner

*Primary Examiner*—LoAn H. Thanh
*Assistant Examiner*—Allana Lewin

(57) ABSTRACT

An apparatus for home use that combines the functions of both a bed and a trampoline. The apparatus includes a base that has a metal frame that is supported by a quartet of braced legs. In addition, a surface is attached to the base through use of a number of springs, with this surface being a flexible surface. A mattress is placed on top of the surface and used for sleeping purposes. The apparatus can be used as a trampoline by removal of the mattress, allowing an individual to jump up or otherwise move about the flexible surface.

7 Claims, 4 Drawing Sheets

DUAL PURPOSE HOME APPARATUS

BACKGROUND OF THE INVENTION

The present invention concerns that of a new and improved apparatus for home use that combines the functions of both a bed and a trampoline by providing a flexible surface underneath a removable mattress.

DESCRIPTION OF THE PRIOR ART

U.S. Pat. No. 3,892,403, issued to Green, discloses an exercise device of the flexible bed type that has a right frame and bed formed of flexible fabric which is yielding supported on the frame in a tightly stretched condition.

U.S. Pat. No. 5,729,852, issued to Rabideau et al., discloses a balloon filled bag for use as a mattress or children's trampoline made of a flexible membrane or textile material and stuffed with air-filled elastic toy balloons of random size.

U.S. Pat. No. 6,733,420 B1, issued to Schroeder, discloses a rectangularly-shaped exercise apparatus having an endless frame formed by angular elements joined together at their adjacent corners that include shoulders and gussets.

U.S. Pat. No. 6,129,649, issued to Yang, discloses a trampoline frame with a leg portion and a looped frame portion mounted on the leg portion.

U.S. Pat. No. 6,286,456 B1, issued to Michaelis, discloses a pet bed or similar article which is designed to be comfortable for the pet.

SUMMARY OF THE INVENTION

The present invention concerns that of a new and improved apparatus for home use that combines the functions of both a bed and a trampoline. The apparatus includes a base that has a metal frame that is supported by a quartet of braced legs. In addition, a surface is attached to the base through use of a plurality of springs, with this surface being a flexible surface. A mattress is placed on top of the surface and used for sleeping purposes. The apparatus can be used as a trampoline by removal of the mattress, allowing an individual to jump up or otherwise move about the flexible surface.

There has thus been outlined, rather broadly, the more important features of an dual-purpose home apparatus that the detailed description thereof that follows may be better understood and in order that the present contribution to the art may be better appreciated. There are, of course, additional features of the dual-purpose home apparatus that will be described hereinafter and which will form the subject matter of the claims appended hereto.

In this respect, before explaining at least one embodiment of the dual-purpose home apparatus in detail, it is to be understood that the dual-purpose home apparatus is not limited in its application to the details of construction and to the arrangements of the components set forth in the following description or illustrated in the drawings. The dual-purpose home apparatus is capable of other embodiments and being practiced and carried out in various ways. Also, it is to be understood that the phraseology and terminology employed herein are for the purpose of descriptions and should not be regarded as limiting.

As such, those skilled in the art will appreciated that the conception, upon which this disclosure is based, may readily be utilized as a basis for the designing of other structures, methods and systems for carrying out the several purposes of the present dual-purpose home apparatus. It is important, therefore, that the claims be regarded as including such equivalent constructions insofar as they do not depart from the spirit and scope of the present invention.

It is therefore an object of the present invention to provide a dual-purpose home apparatus which has all of the advantages of the prior art and none of the disadvantages.

It is another object of the present invention to provide a dual-purpose home apparatus which may be easily and efficiently manufactured and marketed.

It is another object of the present invention to provide a dual-purpose home apparatus which is of durable and reliable construction.

It is yet another object of the present invention to provide a dual-purpose home apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
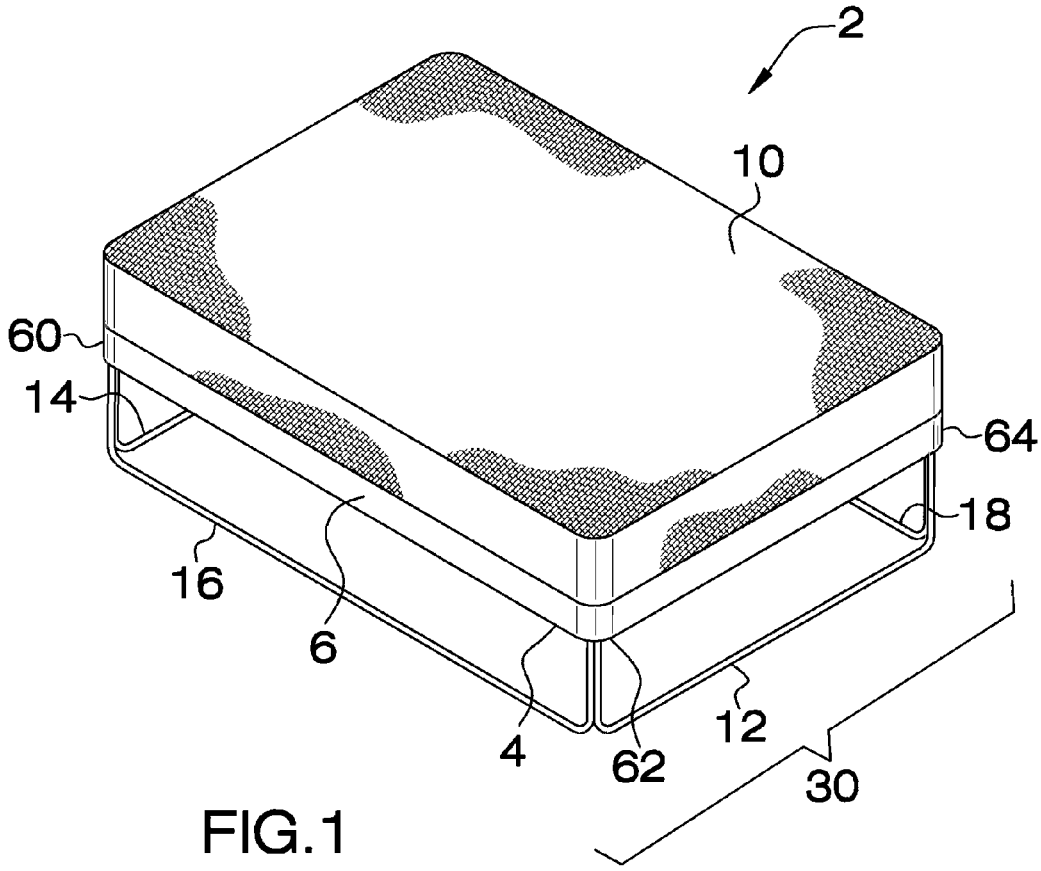
FIG. 1 shows a perspective view of the dual-purpose home apparatus as it would appear in use.
Figure 2:
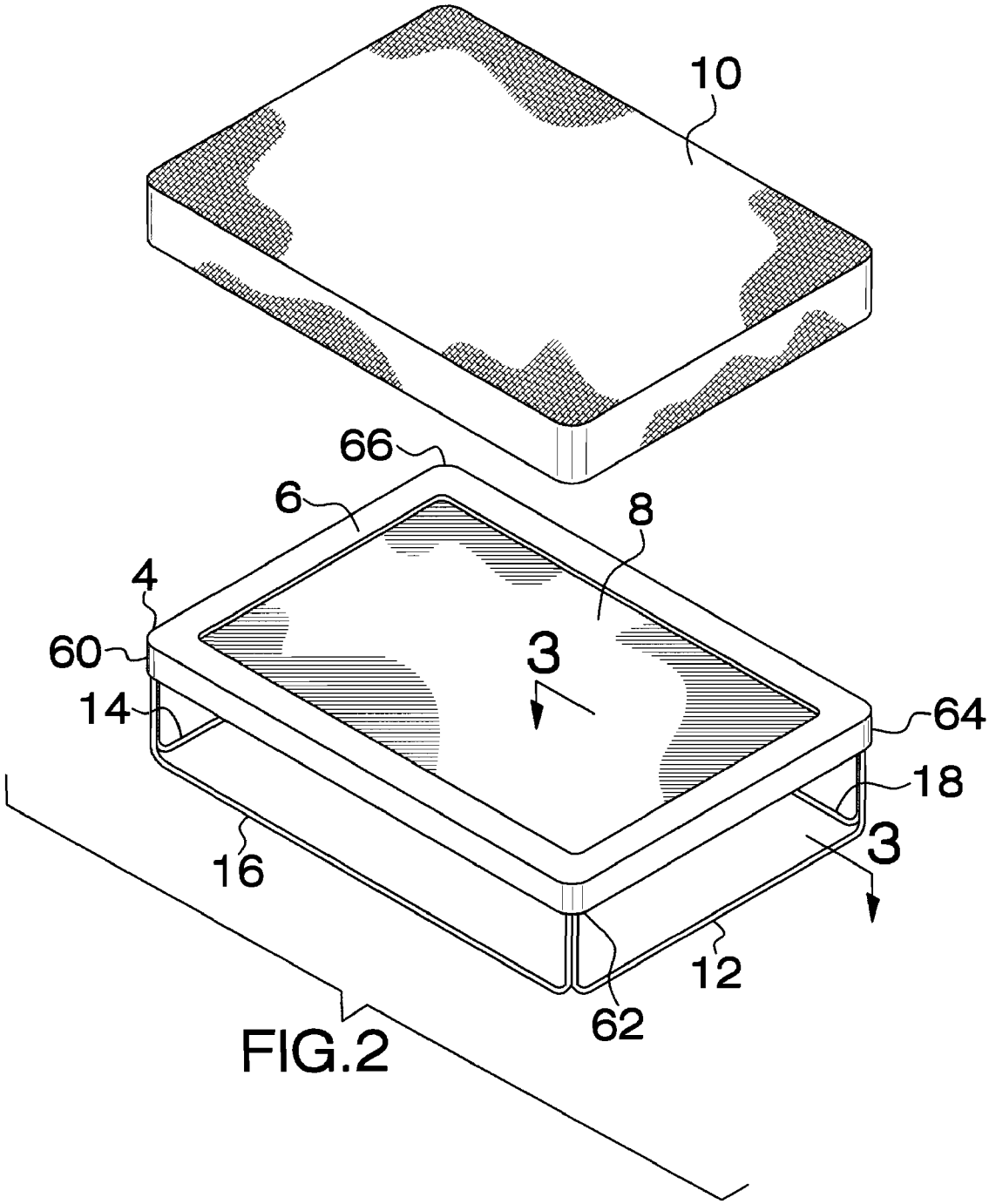
FIG. 2 shows a perspective view of the dual-purpose home apparatus after the mattress has been pulled away from the base and the surface attached to the base.
Figure 3:
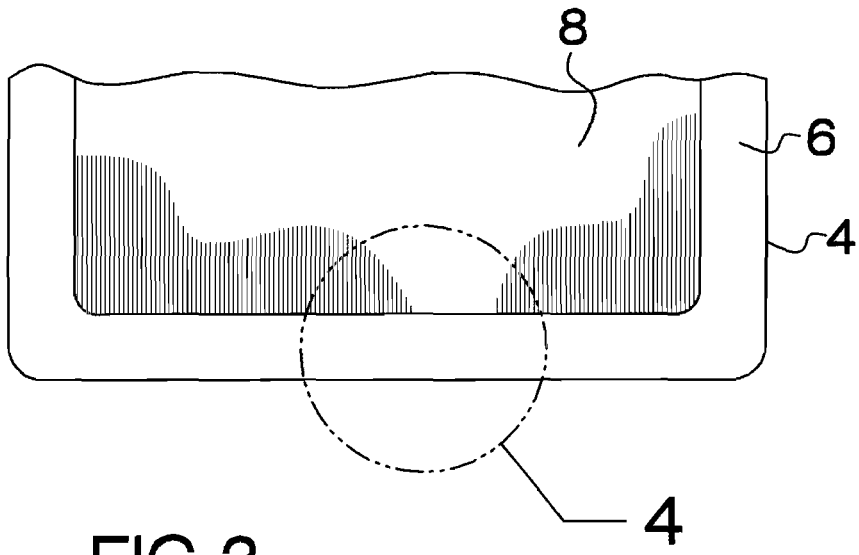
FIG. 3 shows a top view of the base and the surface of the dual-purpose home apparatus.
Figure 4:
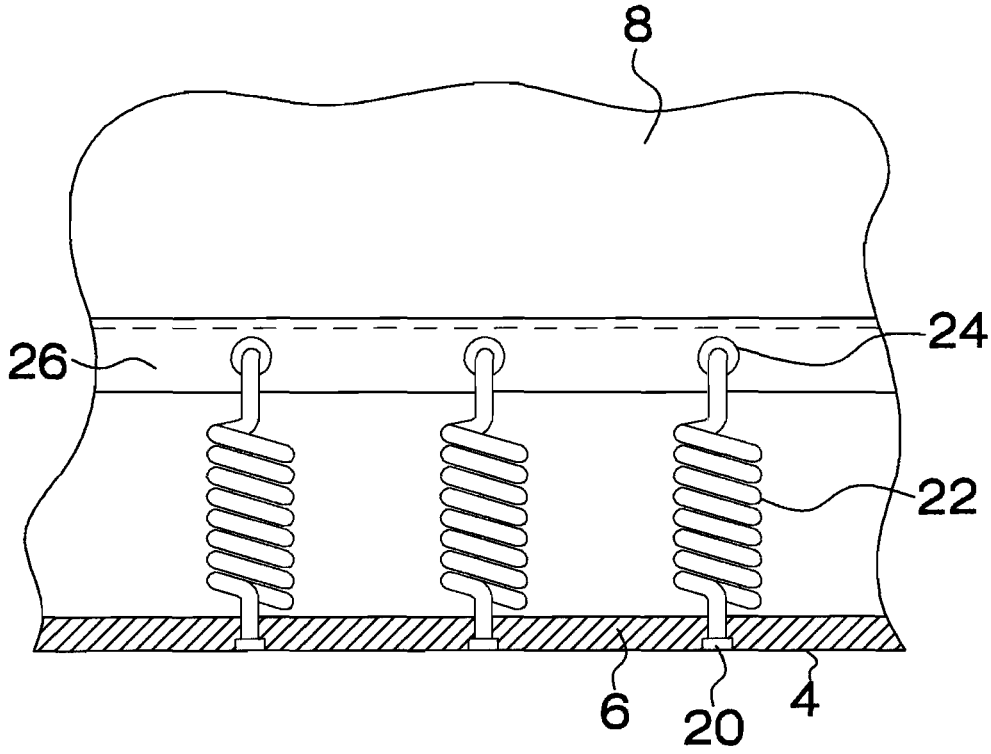
FIG. 4 shows a top view of the base and the surface of the dual-purpose home apparatus, highlighting the attachment of the surface to the frame of the base by a plurality of springs.
Figure 5:
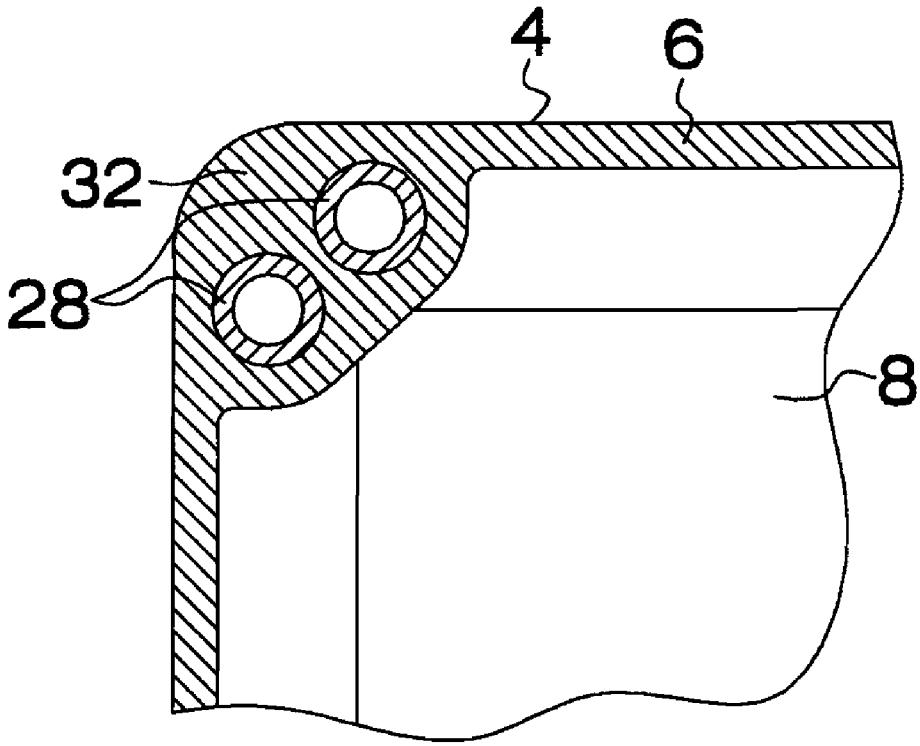
FIG. 5 shows a top view of the base and the surface of the dual-purpose home apparatus, highlighting the leg sockets used to attached the braced legs to the frame of the base.

With reference now to the drawings, and in particular to FIGS. 1 through 5 thereof, a new dual-purpose home apparatus embodying the principles and concepts of the present invention and generally designated by the reference numeral 2 will be described.

As best illustrated in FIGS. 1 through 5, the dual-purpose home apparatus 2 comprises a rectangular-shaped base 4, with the base 4 itself comprising a frame 6 which is also rectangular. The frame 6 has two ends comprising a first end and a second end and also has two sides comprising a left side and a right side. The frame 6 is open in the center and has four corners 60, 62, 64 and 66.

The frame 6 is mounted off of a ground surface 30 by a plurality of braced legs. The first end and second end of the frame 6 are supported by end legs 12 and 14, respectively, while the first side and second side of frame 6 are supported by side legs 16 and 18, respectively. Each leg 12-18 has two ends, a first end and a second end, with the legs 12-18 each being U-shaped. Each end of each leg is mounted to the frame 6 by a leg socket 28, with each of the leg sockets 28 being mounted on a support platform 32 that is located in each corner of the frame. When the legs 12-18 are properly mounted in each of the sockets 28 and support platforms 32, the frame 6 of the base 4 is 15 inches off of the ground surface 30.

A surface 8 is used in conjunction with the apparatus 2. The surface 8 is rectangular in shape and preferably is a trampoline surface or an elasticized nylon panel. The surface 8 can have a wide variety of shapes but in order to be utilized with a standard twin mattress, preferably measures 75 inches in length and 39 inches wide. The surface 8 has a continuous, reinforced edge 26 that has a plurality of eyelets 24 even dispersed along its length.

A plurality of springs 22 are used to attach the surface 8 to the frame 6. Each spring 22 has two ends, a first end and a second end. The first end of each spring 22 is attached to a connector 20 which is attached to the frame 6. A plurality of connectors 20 are attached to the frame and are evenly dispersed through the frame 6. The second end of each spring 22 is attached to an eyelet 24 that is located on the edge 26 of the surface 8. The springs 22 are generally taut but have a little flexibility, allowing the surface 8 to be used as a trampoline surface.

Generally, to be used as a bed, a mattress 10 is placed on top of the frame 6, thereby covering the surface 8. The mattress 10 preferably is fabricated from a four-inch thick foam material. When an individual wishes to use the apparatus 2 to jump on instead of for sleeping, the individual can remove the mattress and then utilize the surface 8 as a trampoline surface.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A dual-purpose apparatus comprising:

(a) a base, the base having a rectangular shape, the base including a frame, the frame including two ends comprising a first end and a second end, the frame also including two sides comprising a first side and a second side, (b) a flexible surface, the flexible surface including a continuous, reinforced edge, (c) a mattress placed on the flexible surface, (d) means for attaching the surface to the frame, (e) means for supporting the base on a ground surface, wherein the means for attaching the surface to the frame further comprises:

(f) a plurality of connectors attached to the frame, (g) a plurality of springs, each spring having two ends comprising a first end and a second end, the first end of each spring being attached to a connector of the plurality of connectors, (h) means for attaching each spring to the surface, wherein the means for attaching each spring to the surface further comprises:

(i) a plurality of eyelets evenly dispersed on the edge of the surface, (j) wherein the second end of each spring is attached to an eyelet of the plurality of eyelets, wherein the means for supporting the base on a ground surface further comprises:

(k) a quartet of support platforms, wherein one support platform is located in each corner of the frame, (l) a pair of end legs comprising a first end leg and a second end leg, each end leg having two ends, a first end and a second end, each end of each end leg being attached to a corner of the frame, and (m) a pair of side legs comprising a first side leg and a second side leg, each side leg having two ends, a first end and a second end, each end of each side leg being attached to a corner of the frame.

2. A dual-purpose apparatus according to claim 1 wherein each end leg and each side leg is U-shaped.

3. A dual-purpose apparatus according to claim 2 wherein the frame further comprises:

(a) a pair of leg sockets attached to each support platform, (b) wherein each end of each leg is attached to a leg socket.

4. A dual-purpose apparatus according to claim 3 wherein the surface has a length of 75 inches and a width of 39 inches.

5. A dual-purpose apparatus according to claim 4 wherein the frame has a height of 15 inches off of the ground.

6. A dual-purpose apparatus according to claim 5 wherein the surface further comprises a trampoline surface.

7. A dual-purpose apparatus according to claim 5 wherein the surface further comprises a elasticized nylon panel.

* * * * *